US008052840B2

(12) United States Patent
Sharoyan

(10) Patent No.: US 8,052,840 B2
(45) Date of Patent: Nov. 8, 2011

(54) PULPING ADDITIVES FOR A REDUCTION OF RESIN FROM KRAFT PULP

(75) Inventor: Davit E. Sharoyan, Hockessin, DE (US)

(73) Assignee: Hercules Incorporated, Wilmington, DE (US)

( * ) Notice: Subject to any disclaimer, the term of this patent is extended or adjusted under 35 U.S.C. 154(b) by 0 days.

(21) Appl. No.: 12/535,983

(22) Filed: Aug. 5, 2009

(65) Prior Publication Data

US 2010/0038043 A1 Feb. 18, 2010

Related U.S. Application Data

(60) Provisional application No. 61/189,180, filed on Aug. 15, 2008.

(51) Int. Cl.

| | |
|---|---|
| ***D21C 3/20*** | (2006.01) |
| *D21C 7/14* | (2006.01) |
| *D21F 1/32* | (2006.01) |

(52) U.S. Cl. ..... 162/72; 162/75; 162/76; 162/82; 162/91; 162/199; 162/48

(58) Field of Classification Search ..... 162/72, 162/75, 76, 82, 91, 199
See application file for complete search history.

(56) References Cited

U.S. PATENT DOCUMENTS

| | | | | |
|---|---|---|---|---|
| 1,790,838 | A * | 2/1931 | Richter et al. | 162/32 |
| 1,814,155 | A * | 7/1931 | Haughey | 162/14 |
| 2,716,058 | A | 8/1955 | Rapson et al. | 92/13 |
| 4,426,254 | A | 1/1984 | Wood et al. | 162/72 |
| 5,501,769 | A * | 3/1996 | Blackstone et al. | 162/76 |
| 6,656,970 | B2 | 12/2003 | Burman et al. | 514/569 |
| 6,689,767 | B2 | 2/2004 | Krasutsky et al. | 514/169 |
| 6,890,533 | B2 | 5/2005 | Bomshteyn et al. | 424/179.1 |
| 7,198,808 | B2 | 4/2007 | Krasutsky et al. | 424/769 |
| 2003/0109727 | A1 | 6/2003 | Kratsutsky et al. | 549/541 |

FOREIGN PATENT DOCUMENTS

| | | |
|---|---|---|
| GB | 1 466 502 | 8/1975 |
| RU | 2 291 684 | 4/2004 |
| WO | 2007/064606 | 6/2007 |
| WO | 2008/028960 | 3/2008 |

OTHER PUBLICATIONS

Pitch Control, Wood Resin and Deresination, TAPPI Press, Chapter 8 (2000) and Dunlop-Jones et al., Journal of Wood Chemistry and Technology 9 (3), 365-386 (1989).

"Evaluation of Methods for Extraction and Analysis of Wood Resin in Birch Kraft Pulp" Research Journal, vol. 18, No. 2, 2003, pp. 129-133.

Ernst L. Back, Pitch Control Wood Resin and Deresination, Chapter 8, pp. 205-230.

P. A. Krasutsky "Birch Bark Research and Development", v 23, 2006, pp. 919-942.

* cited by examiner

*Primary Examiner* — Eric Hug
*Assistant Examiner* — Peter Chin
(74) *Attorney, Agent, or Firm* — Joanne Mary Fobare Rossi

(57) ABSTRACT

Compositions and methods for the removal of resin from wood chips processed in a Kraft pulping process are disclosed. The method is particularly useful for removing triterpene and triterpenoid resin.

12 Claims, No Drawings

PULPING ADDITIVES FOR A REDUCTION OF RESIN FROM KRAFT PULP

This Application claims priority of U.S. Provisional Application No. 61/189,180, filed Aug. 15, 2008, the entire contents of which are herein incorporated by reference.

FIELD OF THE INVENTION

The invention relates to a method for reduction of triterpene or triterpenoid resin found in wood bark and chips, upon Kraft cooking.

BACKGROUND OF THE INVENTION

Removal of pitch and resin is very important for pulping process. If not effectively removed pitch and resin may create fouling problems upon or after pulping and washing, cause increased consumption of bleaching agent(s) and/or form deposits later on the surfaces of papermaking equipment.

Deresination of birch wood in Kraft pulping is especially difficult because birch contains high amounts of unsaponifiable components, betulin being a major unsaponifiable component. Betulin is a naturally occurring pentacyclic triterpenyl alcohol found in birch wood and constitutes up to 35% of the birch bark. Betulin has a melting point at 256° C., which is significantly higher than those of many other pitch components. It is almost insoluble in water and chemically quite unreactive. It does not fully dissolve during the Kraft digestion process and can create deposition problems in the papermaking process.

One way to alleviate the problem is to remove the bark completely from birch before Kraft cooking. Debarking, however, leads to wood loss and yield reduction. As such, it is more desirable to use a digester additive to reduce betulin in the pulp upon Kraft cooking. This has the benefit of decreased betulin deposition and increased pulp yield relative to the current debarking process.

The birch deresination problem has been known for many years, and the only established method in pulping, primarily employed in Scandinavian mills, is the addition of tall oil or rosin soap to chips before the cook process. Black et al., *Pitch Control, Wood Resin and Deresination*, TAPPI Press, Chapter 8 (2000) and Dunlop-Jones et al., *Journal of Wood Chemistry and Technology,* 9 (3), 365-386 (1989) teaches that tall oil increases the amount of saponifiables, thereby boosting the ratio of saponifible-to-unsaponifiable wood resin, which in turn helps emulsify the unsaponifiables and drive them into black liquor.

Tall oil or tall oil soap has been used for many years for reduction of betulin in birch Kraft pulping. However, this method is moderately effective; only removing approximately 50% of betulin when tall oil is used at a 10-30 lb/ton of oven-dried (OD) pulp level. Addition of tall oil is practiced along with effective debarking which leads to a partial wood loss.

The effect of synthetic dispersants has also been investigated. For example, a dodecyl-benzene-sulfonic acid surfactant at 0.5% load has the same deresination effect on birchwood as 3% of softwood tall oil (E. L. Black and H. Allen "Pitch Control, Wood Resin and Deresination", TAPPI press, chapter 8, 2000). However, cost restrictions had put limitations for commercial applications.

There are teachings regarding the isolation of betulin from the bark for medical and cosmetic formulations. This interest stems from the fact that betulin and its derivatives demonstrate strong antiviral, anticancer and anti-inflammatory properties and they have been studied extensively for their pharmaceutical applications. For examples see P. A. Krasutsky, "Birch Bark Research and Development", *Natural Product Reports*, v. 23, 2006, pp. 919-942; R.U. Pat. No. 2291684; U.S. Pat. Nos. 6,890,533, 6,656,970 B2, 7,198,808, and 6,689,767; and U.S. Pat. Appl. 2003/0109727 A1.

It has been previously known that vegetable oils can be used for pitch and resin removal; e.g., see UK Pat. No. 1,466,502. However, these do not mention the effects on betulin and betulin type components.

SUMMARY OF THE INVENTION

The present invention relates to compositions and methods for the removal of triterpene and triterpenoid resin from wood chips processed in a Kraft pulping process. The methods comprise combining wood chips, Kraft pulping liquor, a triglyceride oil, or alkyl derivatives thereof; and at least one of a) poly(alkylene glycol)-based surfactants or b) rosin soap, tall oil; or mixtures thereof, and cooking the resulting mixture in a Kraft pulping process.

In one preferred embodiment, the present invention relates to a method of reducing triterpene and triterpenoid resin from Kraft pulp comprising combining wood chips, Kraft pulping liquor, triglyceride oil or its alkyl derivatives, and one or more compounds in category a) or category b), or mixtures thereof wherein the compounds of category a) comprise poly(alkylene glycol)-based surfactants, wherein the compounds of category b) comprise rosin, rosin soap, tall oil, tall oil soap, or derivatives thereof, and cooking the resulting mixture in a Kraft pulping process.

DETAILED DESCRIPTION OF THE INVENTION

The present invention discloses compositions and methods for the removal of resin, such as triterpene and triterpenoid, from wood chips processed in a Kraft pulping process. More specifically, the invention discloses methods comprising combining wood chips, Kraft pulping liquor, an effective amount of a triglyceride oil, or alkyl derivatives thereof; and at least one of a) poly(alkylene glycol)-based surfactants or b) rosin soap, tall oil; or mixtures thereof, and cooking the resulting mixture in a Kraft pulping process.

By "triglyceride oil", it is defined to mean oils from plant sources; examples include, but are not limited to soybean oil, corn oil, rapeseed oil and mixtures thereof and the like.

The "alkyl derivatives" of triglyceride oil is defined to mean the ester derivative resulting from transesterification of the triglyceride oil with an alcohol; e.g., the fatty acid esters resulting from the transesterification of soybean oil with methanol or ethanol. Examples of triglyceride oil esters include but are not limited to soybean oil alkyl ester, corn oil alkyl ester, and rapeseed oil ester.

By "rosin soap", it is defined to be a neutralization product of naturally occurring resin acid composition comprising a linear, branched, or cyclic alkyl chain, with at least one unsaturated bond, and single carboxylic acid functionality.

By "tall oil", it is defined to be a subset of resin comprising a mixture of fatty acids and resin acids as well as some of sterol, fatty alcohols and hydrocarbons. The resin acids are typically by-products isolated from the Kraft pulping process.

By "poly(alkylene glycol)-based surfactants", it is meant to define compositions comprising alkylene glycol units where a part of the composition is hydrophobic and a part is hydrophilic. Examples of poly(alkylene glycol)-based surfactant are poly(ethylene glycol) alkyl ester, poly(ethylene glycol) alkyl ether, ethylene oxide/propylene oxide homo- and copolymers, or poly(ethylene oxide-co-propylene oxide) alkyl esters or ethers. Other examples include ethoxylated derivatives of primary alcohols, such as dodecanol, secondary alcohols, poly[propylene oxide], derivatives thereof, tridecylalcohol ethoxylated phosphate ester, and the like.

According to present invention, a triterpene and triterpenoid reducing additive or a combination of additives are combined with the chips along with white liquor or combination of white liquor and black liquor. The order by which chips, liquor and additive(s) are added is not important, however it is desirable to mix the additive(s) with white liquor for better mixing and distribution. The use of this method results in an increase in the yield of pulp by enabling one to use wood chips which have not been debarked.

The total cumulative weight of triterpene and triterpenoid reducing additives used in the present invention is typically from about 2 lb/ton (1 gm/kg) of dry pulp to 20 lbs/ton (10 gm/kg) dry pulp. Preferable the amount is from about 2.5 lbs per ton (1.5 gm/kg) to 10 lb/ton. Preferable there is less then 10 lb/ton (5 gm/kg) of additive used.

The Kraft process cooking time, pressure, and temperature can vary depending on preferences of pulp mill setting. For example, the typical cooking conditions for a Kraft mill would be 25-35% for sulfidity, 160-170° C. for maximal cooking temperature, 15-20% for % active alkali, and several hours for a cook time. It is preferable that the temperature in the Kraft Mill is between 140° C. to 170° C. It is preferable that the cook time is from about 1 to about 5 hours. The % active alkali is defined as a mass ratio of sodium sulfide and sodium hydroxide (expressed on $Na_2O$ basis) over mass of oven dry (OD) wood. The % sulfidity is defined as a ratio of sodium sulfide mass over sum of sodium sulfide and sodium hydroxide masses, where all the masses are expressed on $Na_2O$ basis.

In accordance with the present invention, it was found that application of triglyceride oil and/or its alkyl derivatives, preferably soybean oil and/or soybean oil methyl ester, allows effective extraction of triterpene or triterpenoid resin from wood chips in the Kraft pulping process. Partial or complete elimination of debarking increases the pulp yield. It has also been further found that the triterpene or triterpenoid reduction can be enhanced when the triglyceride oil and/or its alkyl derivatives, preferably the soybean oil and/or soybean oil methyl ester, is combined with rosin soap, tall oil, surfactant, or combinations thereof.

In one embodiment of the invention the triterpene or triterpenoid is betulin from birch bark, According to present invention, a number of additives decrease the triterpene or triterpenoid, such as betulin, in pulp upon Kraft cooking. While not being bound by theory, it is believed that the additives of the present invention function by either better penetration of white liquor and additives into wood chips, stabilization of triterpene or triterpenoid particles in black liquor, or a combination thereof, thus reducing triterpene or triterpenoid content in the pulp.

The triterpene or triterpenoid reduction is significantly enhanced by blending of soybean oil or soybean oil methyl ester with a higher average molecular weight surfactant or a longer chain polyethylene glycol such as, for example, MAPEG 600 DOT surfactant. Possible explanations include, but not limited to enhancement of oil solubility in black liquor, enhancement of penetration of liquor and additives into chips, or a combination of both. The length of the polyethylene glycol chain is an important factor in deresination, with PEG-600 being considerably more effective than low molecular weight PEGs.

It is preferable when using a poly(alkylene glycol)-based surfactant in the invention that the surfactant has greater than an average of 9 units of ethylene glycol, preferable greater than an average of 10 units of ethylene glycol.

The present invention can be used for improvement in deresination of wood sources such as birch, eucalyptus and tropical hardwood. These include the deresination of eucalyptus to reduce levels of β-sitosterol (m.p. 140° C.), another type of triterpene alcohol structurally similar to betulin.

The present invention can be used for the deresination of tropical hardwoods for reduction of dammar resin. Dammar resin is a complex mixture of triterpenoids with tetracyclic and pentacylic skeletons and sesquiterpenes. Some of these triterpenes occur as acid derivatives, others as alcohols, esters or ketoderivatives. A part of dammar resin appears as a higher molecular weight (from 1,000 to 10,000) polysesquiterpenes, known as β-resene. Melting points of dammar components, like in case of betulin are quite high; they range from 80° C. and can go as high as 320° C.

The present invention will now be described with reference to a number of specific examples that are to be regarded as illustrative and not restricting the scope of the present invention.

EXAMPLES

The compositions of the present invention were evaluated for their ability to extract betulin from Birch chips in the following manner. Birch chips (19.8 g) mixed with Birch bark (0.2 g) were mixed with a synthetically made white liquor (an aqueous solution of sodium hydroxide and sodium sulfide, 75 g) and optionally a composition of the present invention and cooked in a Model 4750 Parr bomb at 180° C. for 5 hours at a sulfidity of 25% and active alkali charge of 20%. Afterwards, the contents of the Parr bomb were cooled to 100° C. and then filtered through a medium mesh paint filter (with pores size of about 120 microns) while hot.

To determine the betulin content remaining with the pulp, the isolated pulp was washed twice with 80° C. water (1,500 ml) then dried in an oven at 60° C. and a 15 CFHS nitrogen flow until the moisture content was <5 wt %. A sample of the oven dried pulp (1 g) was then extracted with refluxing acetone (150 ml) for 4 hours. An aliquot of the acetone extract (2 ml) was then dried and analyzed by gas chromatography according to the method of Bergelin et al., "Evaluation of methods for extraction and analysis of wood resin in birch kraft pulp", *Nordic Pulp and Paper Research Journal*, Vol. 18, No. 2, 2003, pp. 129-133.

The efficacy of the compositions of the present invention was determined by comparing the results of conducting the experiment with the composition versus a blank experiment conducted absent any compositions of the present invention. Table 1 summarizes these experiments, a benchmark treatment of rosin soap (Dresinate® X rosin soap, available from Hercules Incorporated, Wilmington, Del., USA) was provided for comparison. Results are reported as the betulin level reduction in the pulp wherein 0% equals the blank. The data presented is an average of 4 cooks per example.

TABLE 1

| Example | Treatment | lb/ton | Result % |
|---|---|---|---|
| Comp. 1 | Rosin soap | 10.0 | 6.3 |
| Comp 2 | Soybean oil based methyl ester | 4.5 | 0.7 |
| | PEG (400) Dioleate | 0.5 | |
| 5 | Soybean oil based methyl ester | 3.0 | 5.0 |

TABLE 1-continued

| Example | Treatment | lb/ton | Result % |
|---|---|---|---|
| | Rosin soap | 5.0 | |
| Comp 3 | Soybean Oil | 5.0 | 7.1 |
| Comp 4 | Soybean oil based methyl ester | 5.0 | 8.0 |
| 6 | Soybean Oil | 2.7 | 9.4 |
| | PEG (600) Ditallate | 0.3 | |
| | Rosin soap | 5.0 | |
| 7 | Soybean oil based methyl ester | 2.7 | 10.8 |
| | PEG (600) Ditallate | 0.3 | |
| | Rosin soap | 5.0 | |
| 8 | Soybean oil based methyl ester | 4.5 | 12.2 |
| | PEG (600) Ditallate | 0.5 | |
| 9 | Soybean Oil | 4.5 | 14.6 |
| | PEG (600) Ditallate | 0.5 | |
| 10 | Soybean Oil | 3.0 | 16.9 |
| | Rosin Soap | 5.0 | |

Soybean Oil, available from ADM, Decatur, IL, USA

Soybean based methyl ester (Soygold ® 1000, available from Ag Processing Inc., Omaha, Nebraska, USA)

PEG (400) Dioleate (MAPEG ® 400DO, available from BASF, Florham Park, NJ)

PEG (600) Ditallate (MAPEG ® 600DOT, available from BASF, Florham Park, NJ)

The data indicates that greater amounts of triterpene or triterpenoid are removed when using the method of the invention than would have been expected. For instance when example 10 shows a 16.9% removal rate with a total of 8 lb/ton loading as compared to 10 lbs/ton of rosin soap with a result of 6.3% or 5 lbs/ton of soybean oil with a result of 7.1%. Combining rosin soap with soybean oil at a loading of 8 lbs per ton one would expect a result of no more than about 7%. Combining Soybean oil with poly(alkylene glycol)based surfactant shows similar unexpected results as does the fatty acid derivative of soybean oil.

While the present invention has been described with respect to particular embodiment thereof, it is apparent that numerous other forms and modifications will be obvious to those skilled in the art. The invention described in this application generally should be construed to cover all such obvious forms and modifications, which are within the true scope of the present invention.

The invention claimed is:

1. A method of reducing resin from Kraft pulp comprising combining wood chips, Kraft pulping liquor and at least one triglyceride oil or triglyceride oil alkyl ester, and one or more compounds in category a) and optionally one or more compounds in category b) or mixtures thereof;

a) poly(alkylene glycol)-based surfactant, b) rosin, rosin soap, tall oil, tall oil soap, or derivatives thereof, and cooking the resulting mixture in a Kraft pulping process, wherein one or more compounds in category a) comprises a poly(alkylene glycol)-based surfactant based on dioleate or ditallate that has a PEG segment with a molecular weight of greater than 400, and wherein the triglyceride oil and triglyceride oil alkyl ester comprises at least one of soybean oil, a fatty acid derivative of soybean oil, or mixtures thereof.

2. The method of claim 1, wherein the triglyceride oil is soybean oil.

3. The method of claim 1, wherein the triglyceride oil alkyl ester is soybean oil alkyl ester.

4. The method of claim 1, where the poly(alkylene glycol)-based surfactant comprises poly(ethylene glycol) alkyl ester, poly(ethylene glycol) alkyl ether, ethylene oxide/propylene oxide homo- and copolymers, or poly(ethylene oxide-co-propylene oxide) alkyl ester or ether.

5. The method of claim 3 where the poly(ethylene glycol) alkyl ester is poly(ethylene glycol) ditallate, or poly(ethylene glycol) dioleate.

6. The method of claim 3 where the poly(ethylene glycol) alkyl ester has at least 9 ethylene glycol units.

7. The method of claim 1 wherein the woodchip are selected from the group consisting of birch, eucalyptus tropical hardwood and mixtures thereof.

8. The method of claim 1 wherein the woodchips comprise birch wood chips.

9. A method of reducing resin form Kraft pulp comprising combining wood chips, Kraft pulping liquor and at least one triglyceride oil or triglyceride oil alkyl ester, and at least one poly(alkylene glycol)-based surfactant and cooking the resulting mixture in a Kraft pulping process, wherein the poly(alkylene glycol)-based surfactant is a dioleate or ditallate that has a PEG segment with a molecular weight of greater than 400, and wherein the triglyceride oil or triglyceride oil alkyl ester comprises at least one of soybean oil, a fatty acid derivative of soybean oil, or mixtures thereof.

10. The method of claim 9 wherein the triglyceride oil is soybean oil.

11. A method of reducing resin form Kraft pulp comprising combining wood chips, Kraft pulping liquor and at least one triglyceride oil or triglyceride oil alkyl ester, and one or more compounds selected from the group consisting of rosin, rosin soap, or derivatives thereof; and cooking the resulting mixture in a Kraft pulping process, wherein the triglyceride oil or triglyceride oil alkyl ester comprises at least one of soybean oil, a fatty acid derivative of soybean oil, or mixtures thereof.

12. The method of claim 11 wherein the triglyceride oil is soybean oil.

* * * * *